US005413151A

United States Patent [19]

Moeneclaey

[11] Patent Number: 5,413,151

[45] Date of Patent: May 9, 1995

[54] GRIPPER LOOM RAPIER GUIDE ARRANGEMENT

[75] Inventor: Denis Moeneclaey, Oostnieuwkerke-Staden, Belgium

[73] Assignee: Picanol N.V., Belgium

[21] Appl. No.: 224,512

[22] Filed: Apr. 7, 1994

[30] Foreign Application Priority Data

Apr. 15, 1993 [BE] Belgium ..... 09300369

[51] Int. Cl.[6] ..... D03D 47/27

[52] U.S. Cl. ..... 139/449; 139/446

[58] Field of Search ..... 139/449, 446

[56] References Cited

U.S. PATENT DOCUMENTS

| | | | |
|---|---|---|---|
| 4,010,776 | 3/1977 | Flamand | 139/449 |
| 4,638,839 | 1/1987 | Pezzoli | 139/449 |
| 4,669,513 | 6/1987 | Hintsch | 139/449 X |
| 5,179,979 | 1/1993 | Zollinger | 139/449 |
| 5,183,084 | 2/1993 | Moeneclaey | 139/449 |

FOREIGN PATENT DOCUMENTS

| | | | |
|---|---|---|---|
| 0406926 | 1/1991 | European Pat. Off. . | |
| 2270356 | 12/1975 | France . | |
| 2642093 | 7/1990 | France | 139/449 |
| 1146843 | 7/1986 | Japan | 139/449 |

*Primary Examiner*—Andrew M. Falik
*Attorney, Agent, or Firm*—Bacon & Thomas

[57] ABSTRACT

A gripper loom includes guides mounted laterally outside the shed and guides displaceable into and out of said shed. Both guides engage guide surfaces of a rapier to guide the rapier, but the set of guide surfaces engaged by the guides mounted laterally outside the shed and the set of guide surfaces engaged by the guides displaceable into and out of the shed are located at different sites on the rapier.

14 Claims, 8 Drawing Sheets

5
F6
19
13
2
1
11
14
12
F4
9
20
21
18
17
8
16
15

GRIPPER LOOM RAPIER GUIDE ARRANGEMENT

BACKGROUND OF THE INVENTION

1. Field of the Invention

The invention concerns a gripper loom which includes at least one gripper mounted on a rapier insertable into and retractable out of a shed, guides mounted to the side of the shed for guiding the rapier by engaging guide surfaces of the rapier, and guides insertable into and retractable from the shed for also guiding the rapier by engaging guide surfaces of the rapier.

2. Description of Related Art

U.S. Pat. No. 5,183,084 discloses a gripper loom in which a weft yarn is inserted by two grippers into a shed. Illustratively, the grippers are mounted on a flexible rapier. A first gripper moves the weft from one side into the shed as far as its center where a second gripper takes over insertion of the weft and moves the weft to the opposite shed side. The rapiers are inserted into and again withdrawn from the shed by drive means containing a drive gear cooperating with the rapier. The rapiers are held in contact with the drive gears by contact pads. Guides for the rapier are mounted laterally outside the shed between the drive gear and the shed and cooperate with guide surfaces of the rapier which they align in the direction of the shed. Moreover, a plurality of guides insertable into and retractable from the shed are provided to guide the rapier along guide surfaces inside the shed. In this design, the guide surfaces of the rapiers undergo rapid wear. As a result of this wear, rapier guidance is degraded, and hence they cannot be made to enter the shed in a clearly positionally defined manner.

SUMMARY OF THE INVENTION

It is accordingly an objective of the invention to provide a gripper loom in which, on the one hand, rapier wear is reduced and, on the other hand, the degrading effects of the wear are also reduced.

This objective is achieved by providing a gripper loom in which the rapier guide surfaces associated with the guides mounted laterally outside the shed and the rapier guide surfaces associated with the guides insertable into and retractable out of the shed are located at different sites of the rapier.

The invention is based on the insight that wear is predominantly caused by the displaceable guides. The displaceable guides have only relatively small guide surfaces and are difficult to accurately align as each guide is individually affixed to the displaceable supporting structure. As a result, a significant amount of wear is caused by inaccurate alignment of the displaceable guides. Because, in the invention, the displaceable guides and the guides mounted outside the shed do not act on the same guide surfaces of the rapier, wear of the guide surfaces associated with the guides mounted outside the shed is substantially precluded, resulting in more accurate guiding of the rapier regardless of the wear of the guide surfaces associated with the displaceable guides, whereby accurate insertion into the shed is assured. Furthermore, vibrations or oscillations of the rapier when inserted into or retracted out of the shed are substantially reduced and again rapier wear is reduced at the displaceable guides. Finally, according to a preferred embodiment of the invention, the guide surfaces associated with the guides outside the shed may be extended substantially over the entire length of the rapier so that it is guided continuously.

Further advantages and features of the invention are elucidated in the description below of the illustrative embodiments shown in the drawings.

DETAILED DESCRIPTION OF THE PREFERRED EMBODIMENTS

Figure 1:
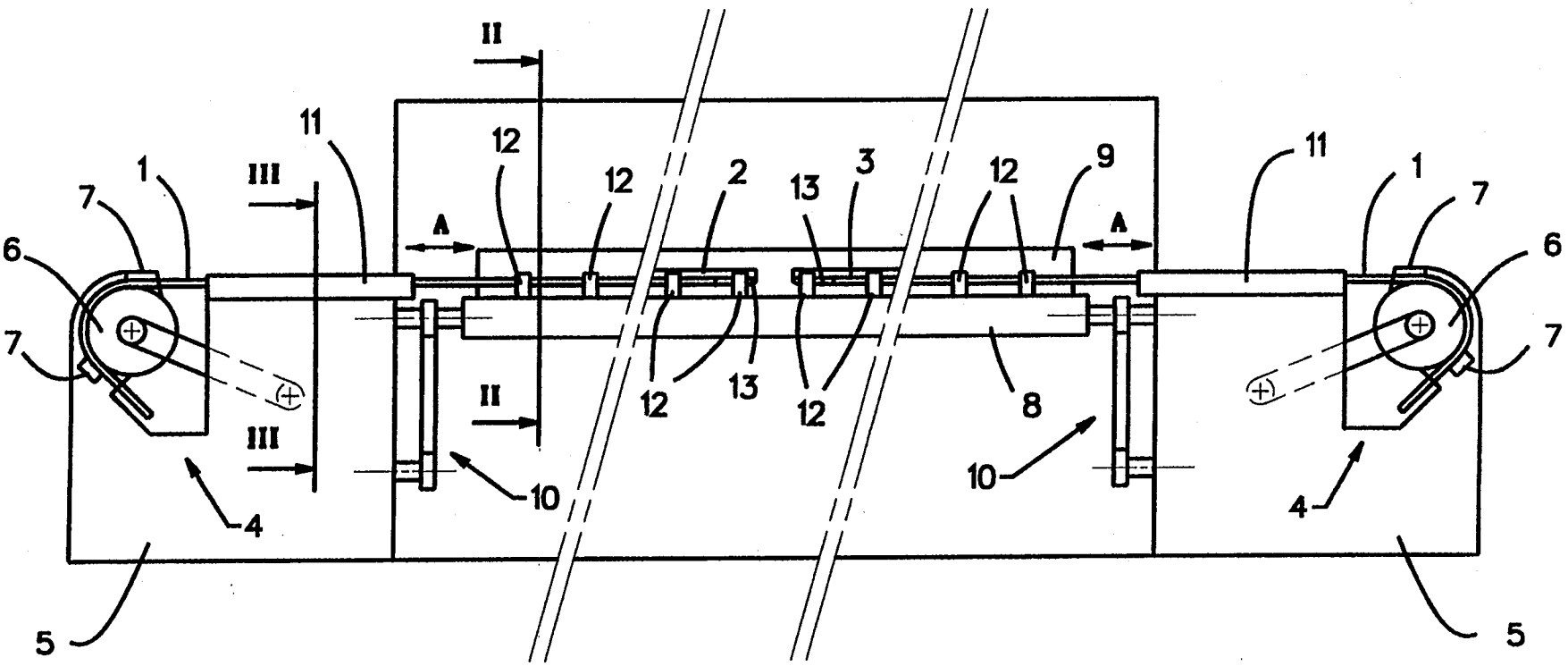
FIG. 1 is a schematic front view of a gripper loom constructed in accordance with the principles of a preferred embodiment of the invention.
Figure 2:
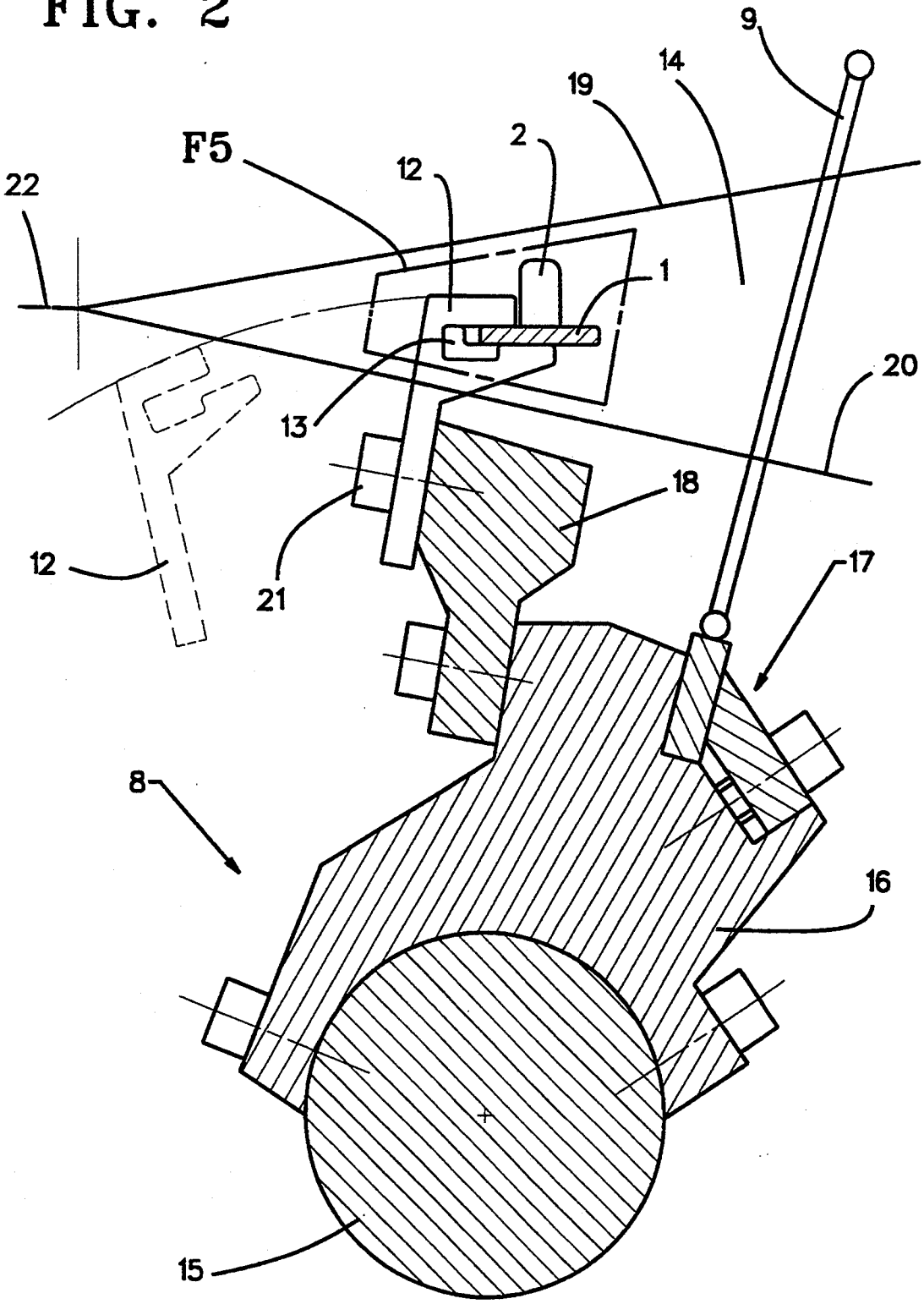
FIG. 2 is an enlarged section along line II—III of FIG. 1.
Figure 3:
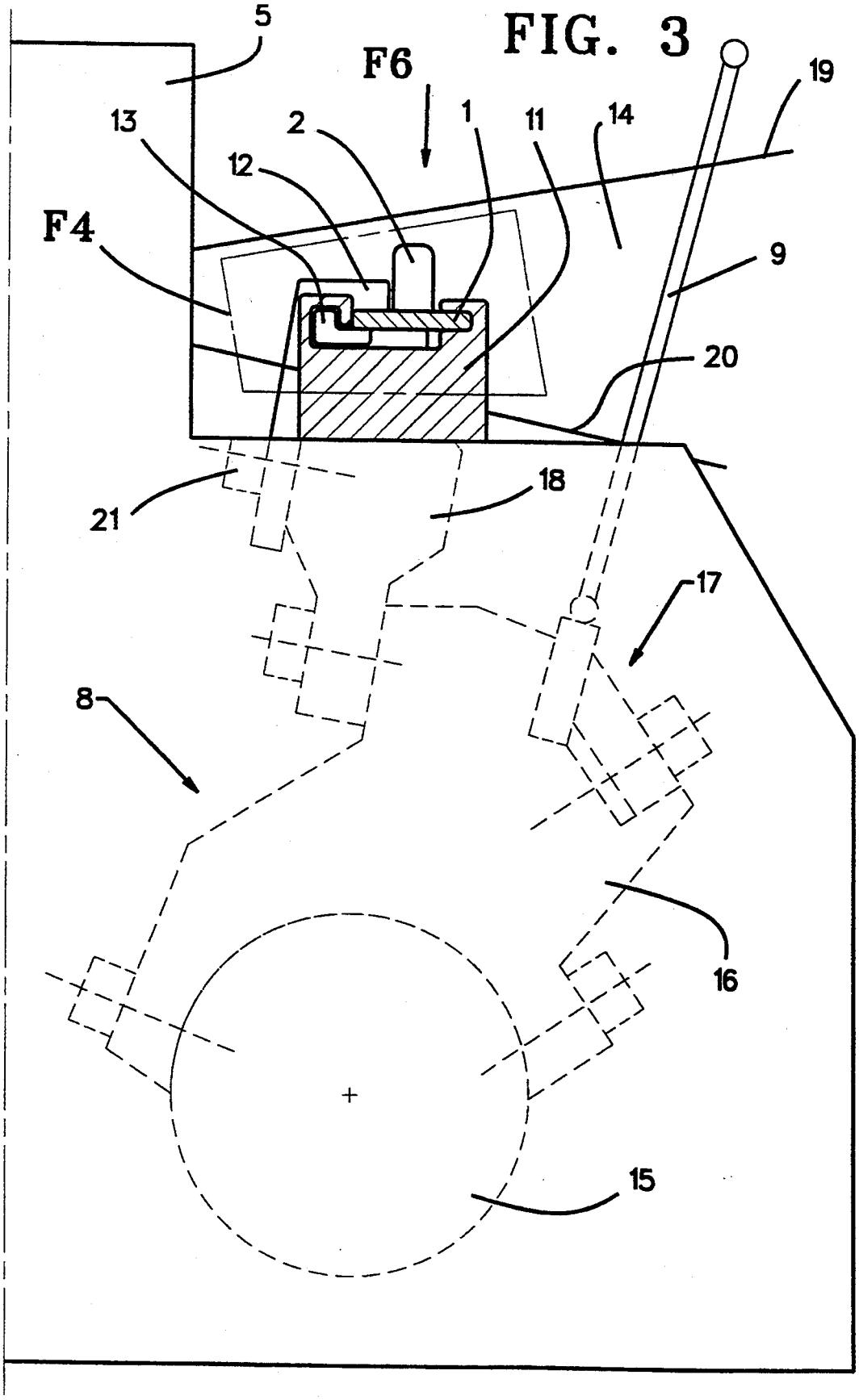
FIG. 3 is an enlarged section along line III—III of FIG. 1.

The gripper loom shown in FIGS. 1 through 3 includes two rapiers 1. One rapier 1 supports a gripper 2, the so-called donor gripper, which conveys a weft from one side to the machine center. The other rapier 1 is fitted with a gripper 3, the so-called receiver gripper, which takes charge of the weft and moves it to the opposite side of the loom. Drive means 4 for the rapiers 1 are present in the zone of lateral frames 5. These drive means each includes a drive gear 6 for engaging and moving a respective one of the rapiers. Guide pads 7 are associated with the drive gears 6 to keep the rapiers 1 against the drive gears. A reed batten 8 rests in the lateral frames 5 and supports a reed 9. The reed batten 8 is fitted with drives 10 synchronized with the drive means 4 of the rapiers 1.

Guides 11 are mounted laterally outside the shed, between the drive gears 6 and the reed batten 8, so as to guide the rapiers 1 to the shed 14, and are stationary relative to the weaving loom frame. Those skilled in the art will appreciate, however, that in arrangements where the drive means 4 and drive gears 6 are movable along with the reed batten 8, rather than stationary as illustrated, stationary guides 11 also should be mounted to be movable with the reed batten 8 so as to remain stationary relative to the drive means and drive gear when the reed batten is moved. In addition, a plurality of displaceable guides 12 are affixed to the reed batten 8 and displaced by a motion of the reed batten 8 into and out of the shed 14. These displaceable guides guide the rapier inside the shed. One guide component 13 is affixed to the particular rapier 1 for every donor gripper 2 and receiver gripper 3 and also cooperates with the displaceable guides 12.

As shown in FIGS. 2 and 3, the reed batten 8 includes a reed-batten shaft 15 bearing a reed-batten fitting 16. A reed 9 is affixed by a reed clamp 17 to the reed-batten fitting 16. A further fitting 18 is affixed to the reed-batten fitting 16 and individual guides 12 displaceable into and out of the shed 14 are fastened to it by screws 21. The shed 14 is formed between upper warps 19 and lower warps 20 by means of shed-forming devices (not shown) with the warps 19, 20 converging toward the fabric 22. The reed batten is shown in its rear position in FIGS. 2 and 3, in which the shed is completely open and the guides 12 displaced into the shed 14 are at least approximately aligned with the guides 11 positioned outside the shed 14. The displaceable guides 12 are moved into and out of the shed 14 by the motion of the reed batten, as indicated by the dashed lines on the left in FIG. 2. In the position shown in FIGS. 2 and 3, the rapiers 1 are moved to-and-fro with the donor gripper 2 and the receiver gripper 3 to insert a warp in the direction of the arrows A shown in FIG. 1.

Because the guides for the rapiers 1 will have the same design for both the donor gripper 2 and the receiver gripper 3, a detailed description of only one set of guides should enable those skilled in the art to make and use guides for both rapiers and, consequently, the following discussion sets forth details only of the guides associated with the rapier 1 of the donor gripper 2.

The rapier 1 includes two sets of guide surfaces located at different sites around a perimeter of a cross-section through the rapier. One set of guide surfaces, consisting of guide surfaces 23, 24, 25, 26, cooperates exclusively with the stationary guides 11 and not with the guides 12 affixed to the reed batten 8 and displaced into and out of the shed 14. The guide surfaces 23, 24, 25, 26 cooperate with the stationary guides 11 affixed in a stationary manner outside the shed 14 so as to guide the rapier is guided in two essentially mutually perpendicular transverse directions B and C. In the embodiment shown in FIGS. 2 and 3, the two narrow sides of the rapier 1 serve as guide surfaces 24, 26. Edge zones of the top and bottom sides of the rapiers and in the vicinity of a narrow side serve as further guide surfaces 23, 25. The stationary guides 11 include corresponding guide devices 27, 28, 29, 30.

Figure 4:
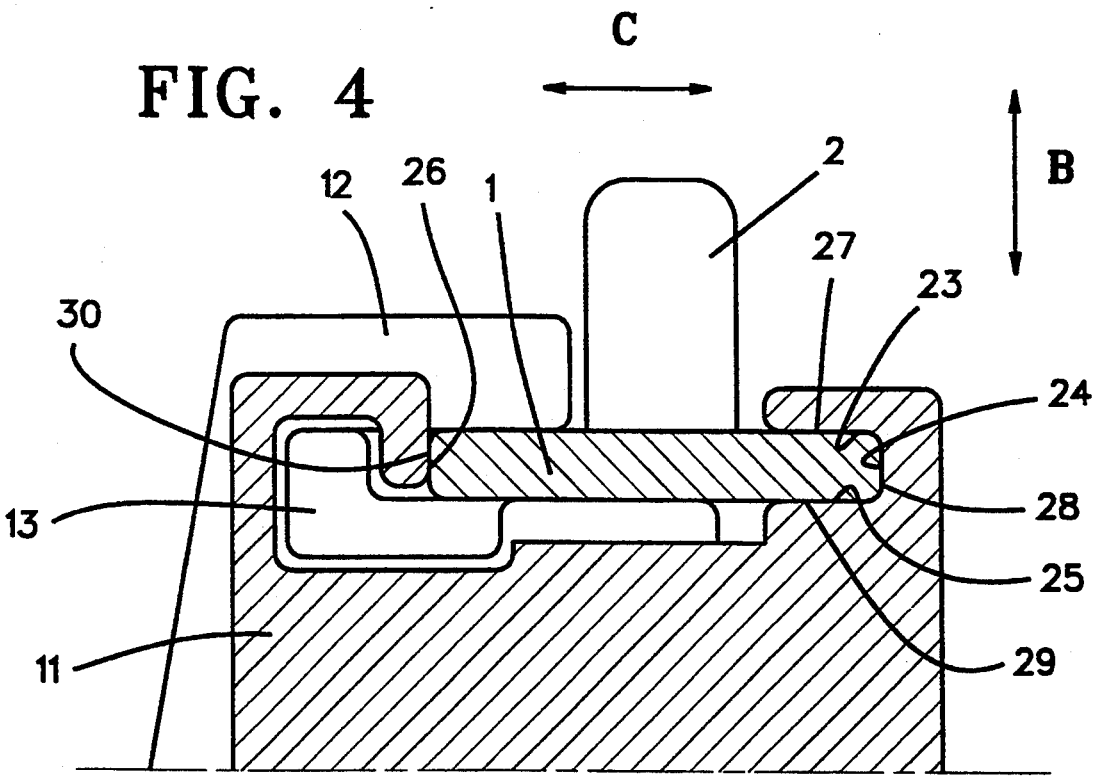
FIG. 4 is an enlarged cutaway F4 of FIG. 3.
Figure 5:
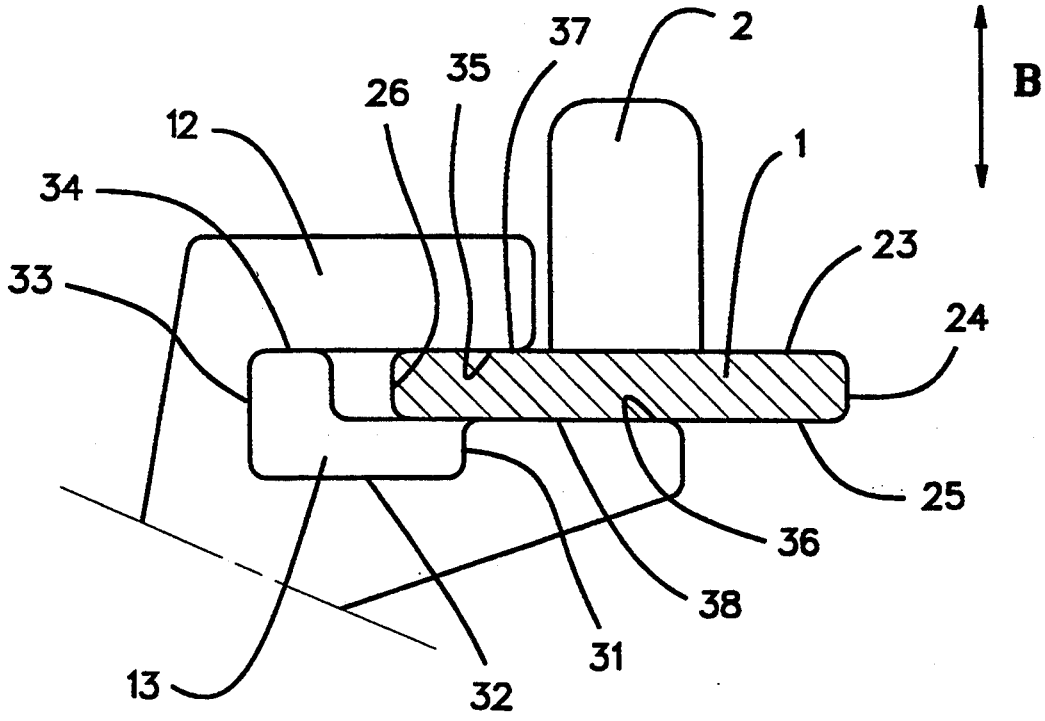
FIG. 5 is an enlarged cutaway F5 of FIG. 2.

As shown in FIG. 4, the guide component 13 includes mutually opposite surfaces 31,33; 32,34, surfaces 33,34 being located on a raised portion of the guide component which extends outside the contour of the rapier such that a relatively wide play is present between the guide component 13 mounted in the zone of the gripper 2 and the stationary guide 11. On the other hand, the guide component 13 has only a minute play at its other mutually opposite surfaces 31, 33; 32, 34 in the corresponding guide channel of the displaceable guides 12. It is possible thereby to accurately guide the grippers 2 or 3 using the guides 12. The displaceable guides 12 furthermore include guide means 37, 38, which cooperate with the second set of guide surfaces, consisting of guide surfaces 35 and 36 of the top side and bottom side of the rapier 1, so that the rapier is also guided by the guides 12 in the direction B transversely to the direction of motion of the rapier 1.

Because the guide surfaces 23, 24, 25, 26 are not guided by the guides 12 insertable into the shed 14, the wear caused thereby is slight. As a result, the rapier is always guided in a well defined position by the guide devices 27, 28, 29, 30 of the stationary guide 11. Because the rapier 1 is constantly guided in two mutually perpendicular directions B and C transversely to the direction of motion inside the stationary guide 11, the advantage is achieved that abrupt motions or vibrations/oscillations will not arise in the rapier 1 when it and the guide component 13 of the gripper 2 and 3 exit the stationary guide 11 or are being returned. Wear at the guide surfaces 35, 36 associated with the displaceable guides 12 will not affect the guidance of the rapier 1 in the guide 11 or the guidance of the guide component 13 in the guides 12. Furthermore, the reduction of vibrations/oscillations in the rapier 1 offers the advantage that the guide surfaces 35, 36 of the rapier 1 and the guide component 13 affected by the guide means 37, 38 of the guides 12 will also undergo less wear. Because the guide surfaces 23 through 26 are not guided by guides 12 inside the shed 14, a larger overlap of reed-batten displacement and gripper motion is made possible. The grippers 2, 3 already can be moved into or withdrawn from the shed 14 when the reed batten 8 is not yet or no longer in its outermost position. This is feasible without thereby being forced to give up displaceable guides 12 in the vicinity of the lateral edge of the shed 14.

Figure 6:
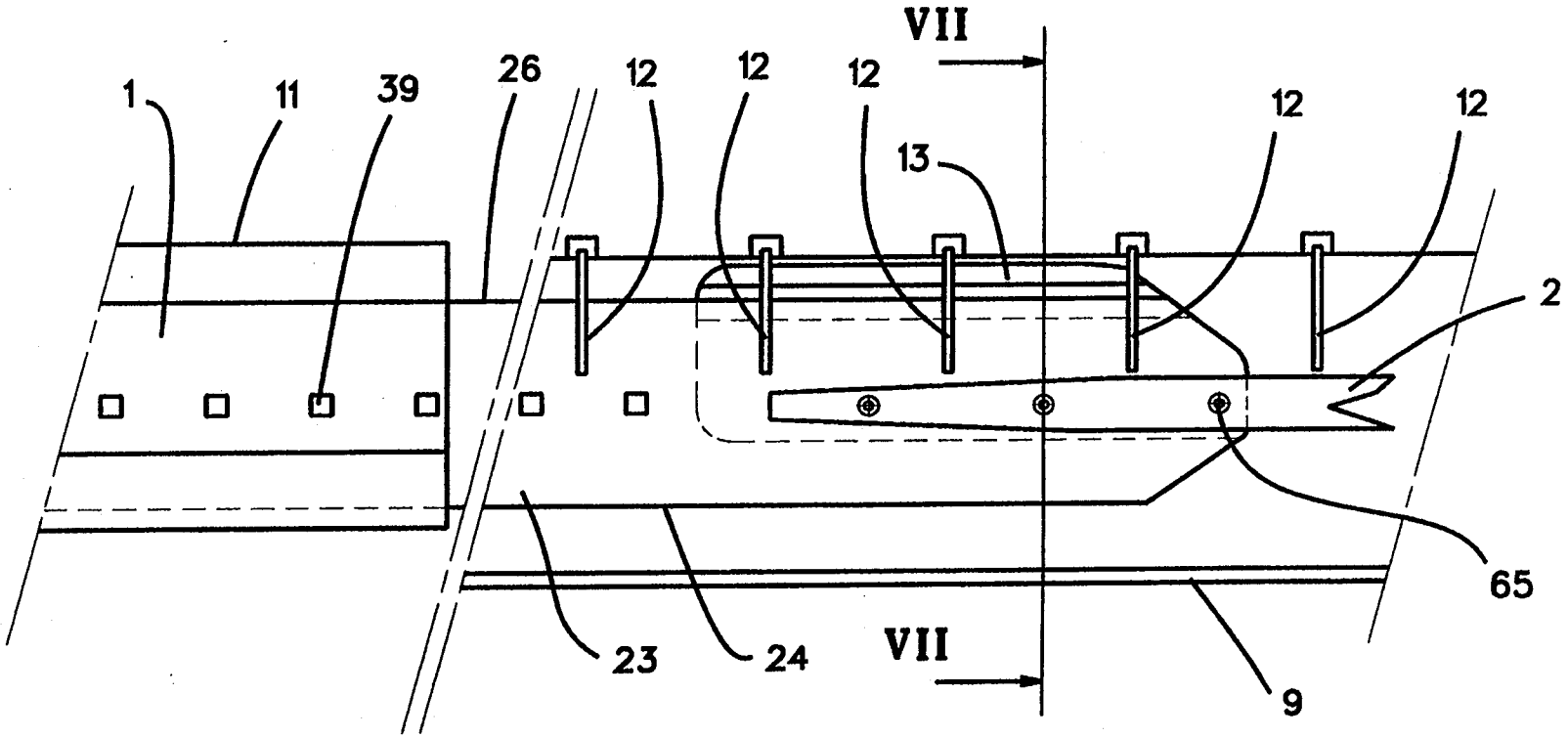
FIG. 6 is an enlarged elevation in the direction of the arrow F6 of FIG. 3.
Figure 7:
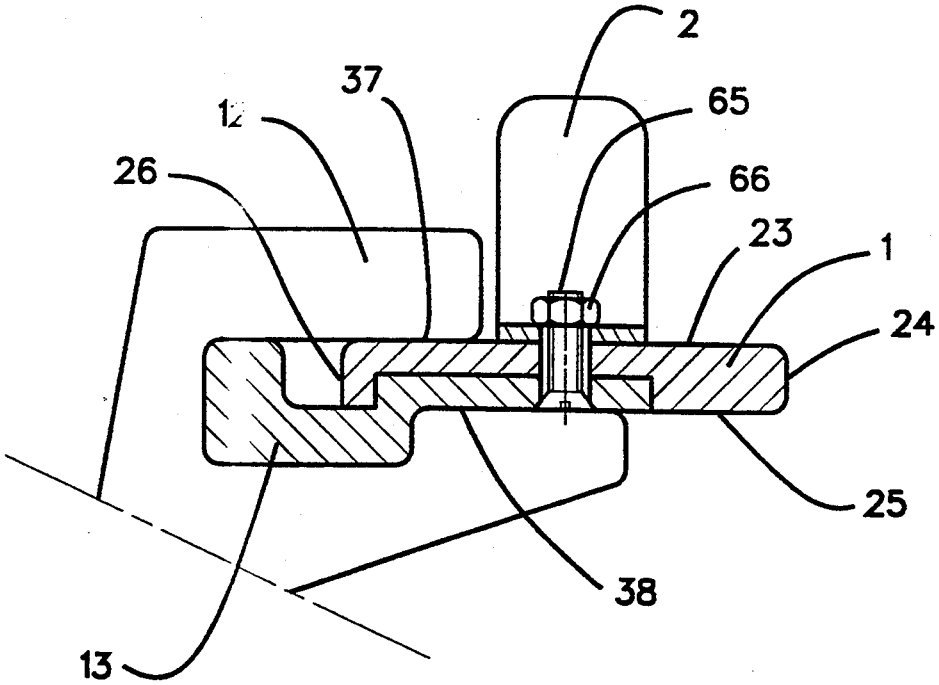
FIG. 7 is a section along line VII—VII of FIG. 6.
Figure 8:
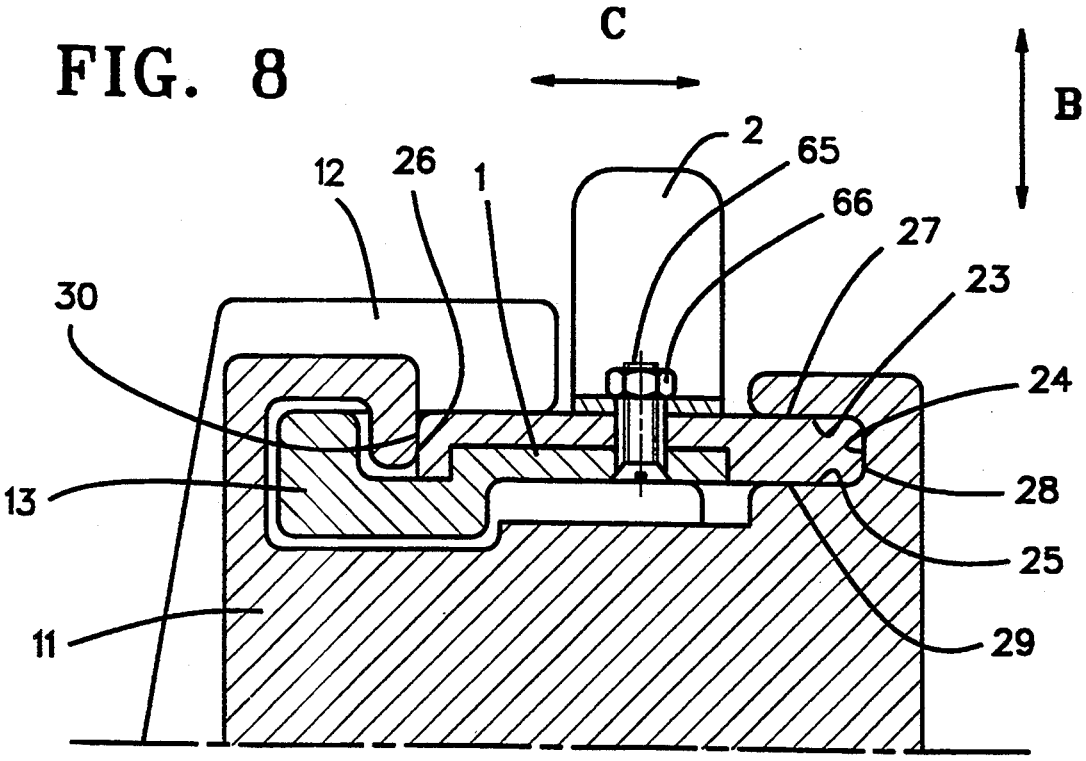
FIG. 8 is a section parallel to the line VII—VII of FIG. 6 in the region of a guide mounted outside the shed.

FIGS. 6–8 show the manner in which the guide component 13 is affixed to the rapier 1 in the region of the donor gripper 2. A clearance is milled into the end of the rapier 1 and receives the guide component 13. Together with the donor gripper 2, this guide component 13 is affixed by screws 65 and nuts 66 to the rapier 1 so that the belt is clamped between the guide component 13 and the donor gripper 2. The receiver gripper 3 is mounted in corresponding manner to its rapier 1. The guide component 13 extends almost to the guide surface 25, but terminates in such a manner that it stays outside guide surface 25 and therefore does not touch the guide device 29 of the stationary guide 11. Accordingly, the rapier 1 is not interrupted in the region of the guide surfaces 24, 25 and no warps can catch between the rapier 1 and the guide device 13, which might entail warp ruptures. This is especially important as regards improperly separated warps, and especially warps located below the rapier 1 but which actually belong to the upper warps 19 and should be above the rapier. Because the guide surfaces 24, 25 that may touch the warps are subject to very little wear, warp damage is averted in this region, and the guide device 13 furthermore does not interfere with the guide surfaces 23 and 26. Finally, with respect to FIG. 6, reference numeral 39 indicates clearances in the rapier which cooperate with teeth on the drive wheel 6 to cause the belt to move as the wheel is driven by drive means 4.

Figure 9:
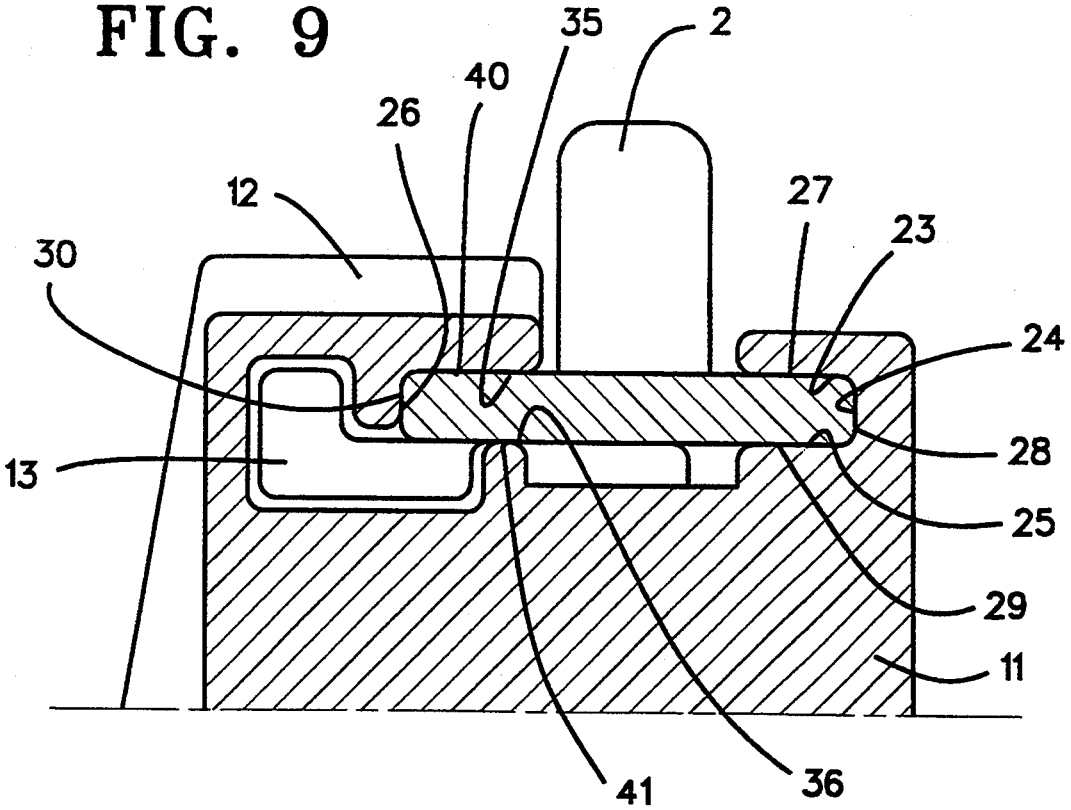
FIG. 9 is a section similar to FIG. 4 of another preferred embodiment of the invention.

FIG. 9 shows an embodiment in which the stationary guide 11 includes guide devices 40, 41 which cooperate with the guide surfaces 35, 36 of the rapier 1 and are associated with the displaceable guides 12. When the guide surfaces 35, 36 of the rapier 1 that are associated with the displaceable guides 12 are worn, the rapier 1 still is reliably guided in the two mutually perpendicular directions B and C transverse to the direction of motion inside the stationary guide 11 by means of the guide devices 27, 28, 29, 30. The guide devices 40, 41 of the stationary guide 11 merely serve to enhance reliability.

Figure 10:
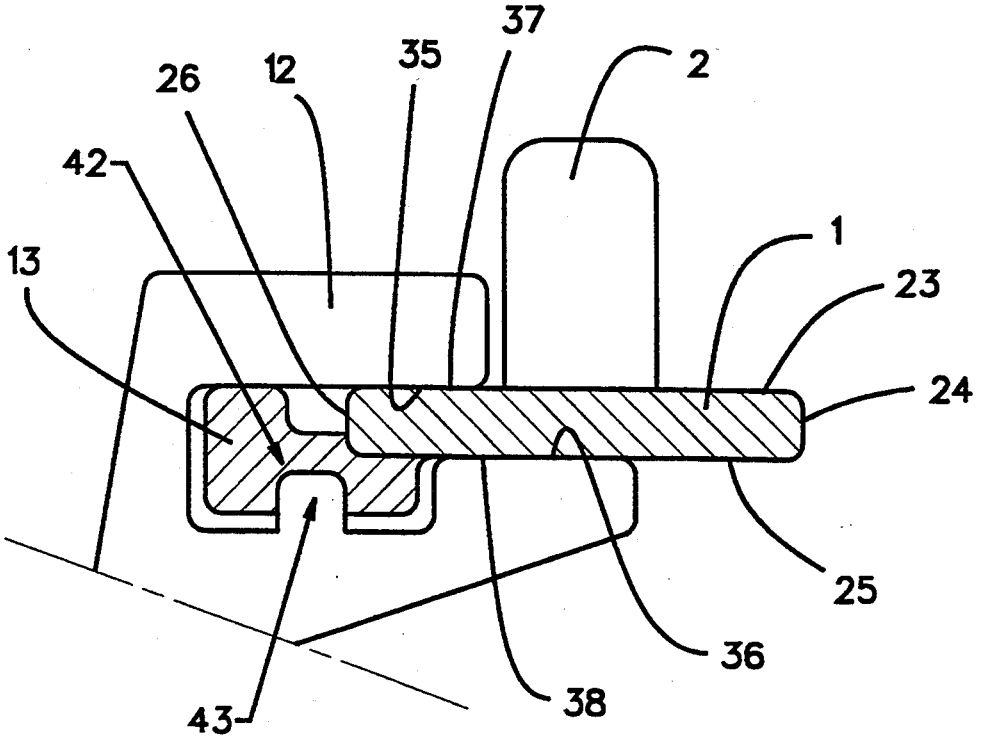
FIG. 10 is a section similar to FIG. 5 of yet another preferred embodiment of the invention.

In the embodiment of FIG. 10, the guide component 13 is fitted with a longitudinal channel 42 associated with a ridge 43 of the guides 12. The danger of catching warps at the guides, which is present for some weaves and/or improperly separated warps, is reduced in this embodiment.

In variations of the above embodiments, a guide part is affixed on the top side of the rapier 1 between the rapier 1 and the gripper 2 or 3. The guide surface 30 of the stationary guide 11, which is associated with a flat side of the rapier 1 serving as the guide surface 26, thus projects away from the bottom side of the rapier 1.

Figure 11:
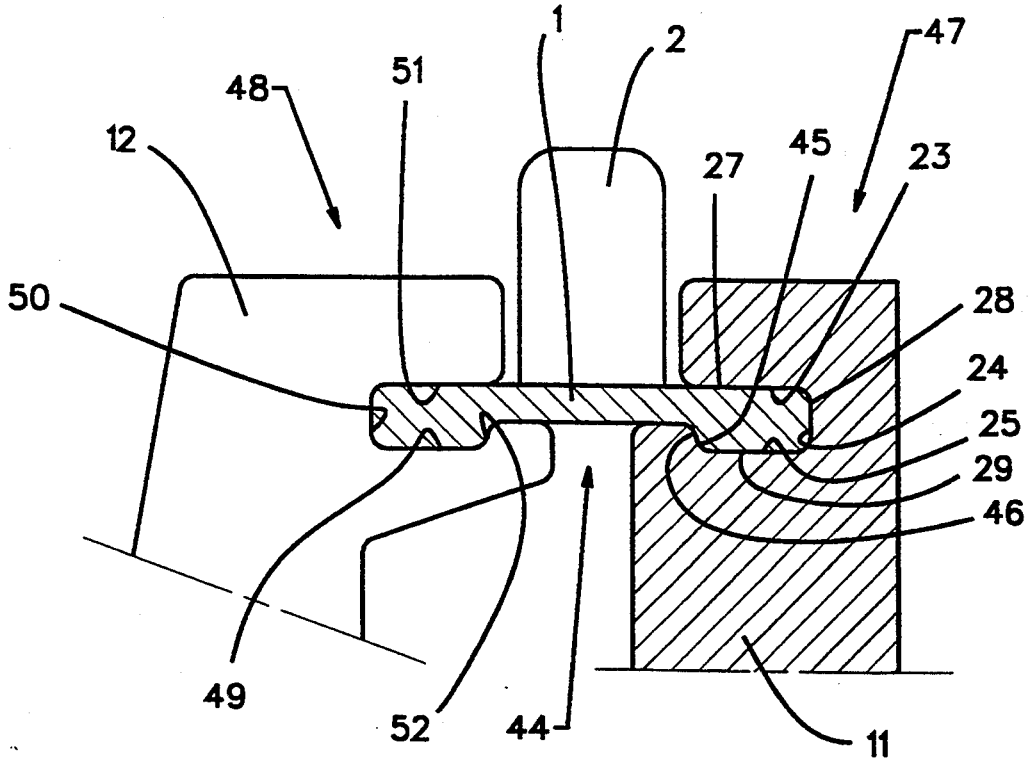
FIG. 11 is a section in the region of a guide mounted outside the shed for yet another preferred embodiment of the invention.

As regards the embodiment of FIG. 11, the rapier 1 includes a longitudinal channel 44. This longitudinal channel 44 creates two longitudinal raised portions of which one serves as guidance in the stationary guide 11 and the other as guidance in the displaceable guide 12. The rapier 1 is guided by the guide surfaces 23, 24, 25 and a guide surface 45 of the sidewall of the longitudinal channel 44 in the guide 11 mounted outside the shed 14. This guide 11 is fitted with corresponding guide devices 27, 28, 29, 46. The guide surfaces 23, 24, 25, 26 are located in the region of the side 47 of the rapier 1 facing the reed 9 and do not cooperate with the guides 12 which are insertable into the shed 14. The longitudinal raised portion of the opposite side 48 of the rapier 1 includes guide surfaces 49, 50, 51, 52 cooperating with the guides 12 insertable into the shed 14. Here again a sidewall of the longitudinal channel 44 serves as a guide surface 52.

Figure 12:
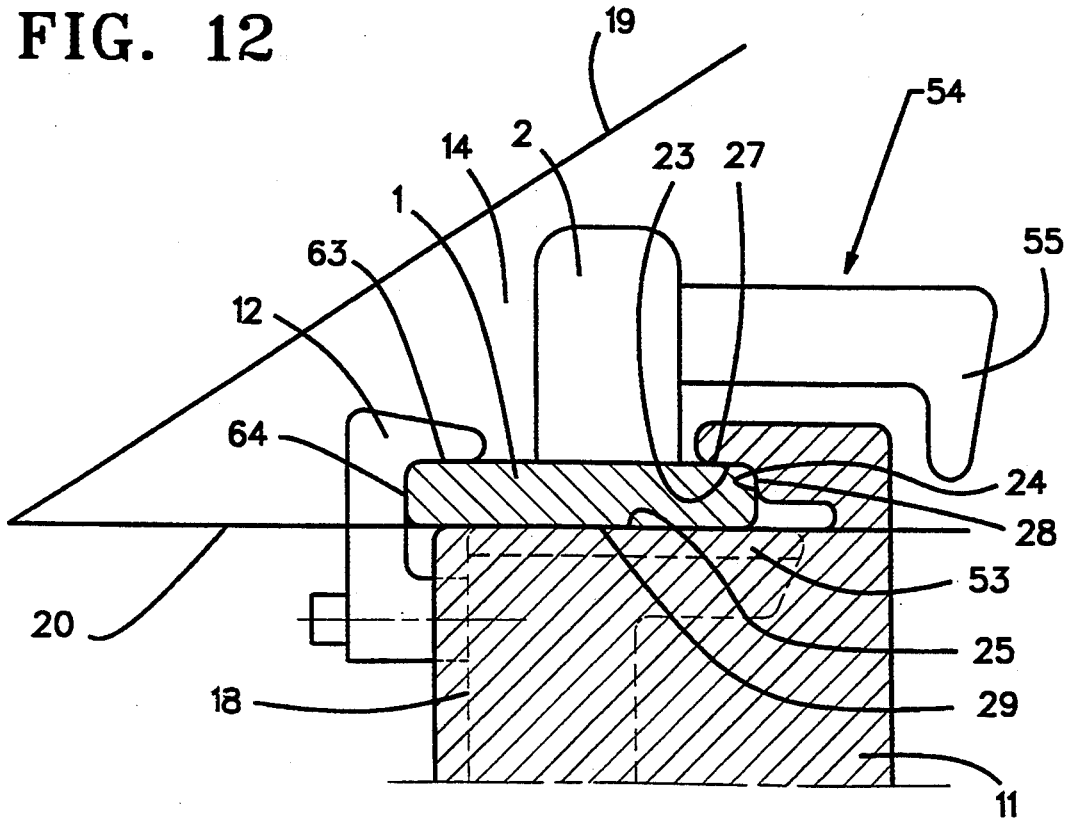
FIG. 12 is a section of a region of a guide mounted outside the shed for a preferred embodiment in which a guide device is mounted on a gripper.

In the embodiment of FIG. 12, the rapier 1 is guided by guide surfaces 23, 24, 25 through guide devices 27, 28, 29 of the stationary guide 11. A rest 53 for the lower warps 20 is mounted on the fitting 18 of the reed batten 8. The rest 53 is made of a soft and/or elastic material. Together with the rest 53, the lower warps 20 provide guidance for the rapier 1. The rapier 1 is guided by guide devices 63, 64 of guides 12 insertable into the shed 14 and mounted on the fitting 18. The guide surfaces 23, 24, 25 do not cooperate with the guides 12. A support 54 is affixed to the gripper 2 and cooperates with the omitted reed 9. The support 54 comprises a shackle cooperating in a manner (not shown) with the stationary guide 11 to increase reliability of guidance.

Those skilled in the art will appreciate that although specific embodiments of the invention have been described in detail herein, it is to be understood that the detailed description and accompanying illustrations are not to be taken as limiting. Instead, it is anticipated that numerous modifications, alterations, and/or substitutions will occur to those skilled in the art and it is intended that all such modifications, alterations, and substitutions be included within the scope of the invention. Consequently, it is intended that the invention be defined solely in accordance with the appended claims.

I claim:

1. A gripper loom, comprising:

at least one gripper;

a rapier having a plurality of guide surfaces;

means for mounting the gripper on the rapier such that the gripper is insertable into and retractable from a shed;

at least one fixed guide mounted outside the shed so as to engage and exclusively guide a first set of said guide surfaces; and at least one displaceable guide mounted for displacement into and out of the shed so as to engage and exclusively guide a second set of said guide surfaces, wherein guide surfaces of said first and second sets are located at different sites on the rapier.

2. A gripper loom as claimed in claim 1, wherein the second set of guide surfaces consists of opposed pairs of said guide surfaces.

3. A gripper loom as claimed in claim 1, wherein the rapier comprises a longitudinal raised portion forming said first set of guide surfaces.

4. A gripper loom as claimed in claim 3, wherein the rapier comprises a longitudinal channel which defines said longitudinal raised portion and also a second longitudinal raised portion extending essentially symmetrically, relative to the first longitudinal raised portion, to a longitudinal axis of the channel.

5. A gripper loom as claimed in claim 1, wherein the rapier comprises a longitudinal raised portion forming said second set of guide surfaces.

6. A gripper loom as claimed in claim 5, wherein the rapier comprises a longitudinal channel which defines said longitudinal raised portion and also a second longitudinal raised portion extending essentially symmetrically, relative to the first longitudinal raised portion, to a longitudinal axis of the channel.

7. A gripper loom as claimed in claim 1, wherein the rapier in the area of the gripper is provided with a guide element, said guide element including said second set of guiding surfaces.

8. A gripper loom as claimed in claim 7, wherein the guide element comprises a raised portion running in a direction of motion of the gripper which forms the guide surfaces for the guide displaceable into and out of the shed.

9. A gripper loom as claimed in claim 1, further comprising a guide device mounted laterally to the gripper and means for guiding the guide device.

10. A gripper loom as claimed in claim 1, wherein the first set of guide surfaces extends at least approximately over an entire length of the rapier.

11. A gripper loom as claimed in claim 1, wherein the first set of guide surfaces consists of pairs of guide surfaces, the guide surfaces in each pair being arranged at least approximately at right angles to one another.

12. A gripper loom, comprising:

at least one gripper;

a rapier;

means for mounting the gripper on the rapier such that the gripper is insertable into and retractable from a shed;

a displaceable guide; and means for mounting the displaceable guide to be insertable into and retractable from the shed, wherein the rapier in the area of the gripper is provided with a guide element, a portion of which extends beyond a contour of the rapier, said guide element having thereon means consisting of a set of guide surfaces for engaging and being guided by the displaceable guide.

13. A gripper loom as claimed in claim 12, wherein the portion extending outside the contour of the rapier comprises a raised portion running in a direction of motion of the gripper, said raised portion forming said guide surfaces.

14. A gripper loom, comprising:

at least one gripper;

a rapier having a plurality of guide surfaces;

means for mounting the gripper on the rapier such that the gripper is insertable into and retractable from a shed;

at least one fixed guide mounted outside the shed so as to engage and guide a first set of said guide surfaces in two mutually perpendicular directions transverse to a direction of motion of the rapier; and at least one displaceable guide mounted for displacement into and out of the shed so as to engage and guide a second set of said guide surfaces, wherein guide surfaces of said first set and guide surfaces of said second set are located at different sites on the rapier.

* * * * *